US010301815B2

(12) United States Patent
Bai

(10) Patent No.: US 10,301,815 B2
(45) Date of Patent: May 28, 2019

(54) GLASS CURTAIN WALL FASTENER

(71) Applicant: GUANGDONG KIN LONG HARDWARE PRODUCTS CO., LTD, Dongguan (CN)

(72) Inventor: Baokun Bai, Dongguan (CN)

(73) Assignee: GUANGDONG KIN LONG HARDWARE PRODUCTS CO., LTD, Dongguan (CN)

( * ) Notice: Subject to any disclaimer, the term of this patent is extended or adjusted under 35 U.S.C. 154(b) by 0 days.

(21) Appl. No.: 15/867,092

(22) Filed: Jan. 10, 2018

(65) Prior Publication Data

US 2018/0195270 A1 Jul. 12, 2018

(30) Foreign Application Priority Data

Jan. 11, 2017 (CN) ..... 2017 1 0021430

(51) Int. Cl.
*E04H 1/00* (2006.01)
*E04H 3/00* (2006.01)
(Continued)

(52) U.S. Cl.
CPC ..... *E04B 1/40* (2013.01); *E04B 2/88* (2013.01); *E06B 3/5427* (2013.01); *E06B 3/5481* (2013.01)

(58) Field of Classification Search
CPC . E04B 1/40; E04B 2/88; E06B 3/5427; E06B 3/5481; E06B 3/54
(Continued)

(56) References Cited

U.S. PATENT DOCUMENTS 5,497,586 A * 3/1996 Dodd ..... E06B 3/025 49/413
5,540,514 A * 7/1996 Demars ..... B32B 17/10036 403/122
(Continued)

FOREIGN PATENT DOCUMENTS

CN 201180326 Y 1/2009
CN 201502118 U 6/2010
(Continued)

OTHER PUBLICATIONS

Extended European Search Report for European Application No. 18150777.3, dated May 3, 2018 (8 pages).
(Continued)

*Primary Examiner* — Joshua J Michener
*Assistant Examiner* — James J Buckle, Jr.
(74) *Attorney, Agent, or Firm* — Kagan Binder, PLLC

(57) ABSTRACT

A glass curtain wall fastener, a first clamping plate is provided opposite to a second clamping plate to hold a glass panel therebetween. A first connecting part is provided on a side of the first clamping plate adjacent to the second clamping plate, the second connecting part is provided on a side of the first clamping plate adjacent to the first clamping plate, and the first connecting part is connected to the second connecting part via a connecting element. A gap is defined between two adjacent glass panels, the first connecting part, the second connecting part, and the connecting element are received in the gap. In a direction from the first clamping plate to the second clamping plate, a sum of an extend length of the first connecting part and an extend length of the second connecting part is less than a thickness of the glass panel.

11 Claims, 4 Drawing Sheets

(51) Int. Cl.

| | |
|---|---|
| ***E04H 5/00*** | (2006.01) |
| ***E04B 2/88*** | (2006.01) |
| ***E04B 1/41*** | (2006.01) |
| ***E06B 3/54*** | (2006.01) |

(58) Field of Classification Search
USPC ..... 52/698
See application file for complete search history.

(56) References Cited

U.S. PATENT DOCUMENTS 5,921,698 A * 7/1999 Hegen ..... E06B 3/5436 403/263
6,105,319 A * 8/2000 Brunt ..... E06B 3/5436 52/204.593
6,131,346 A * 10/2000 Kordes ..... E04F 13/0837 403/388
6,138,434 A * 10/2000 Demars ..... A47F 3/0434 52/786.13
6,430,894 B1 * 8/2002 Chae ..... E04B 2/885 52/204.593
6,519,903 B1 * 2/2003 Dirisamer ..... E04B 2/885 52/204.66
6,796,091 B2 * 9/2004 Elmer ..... E04F 13/145 403/388
7,571,575 B2 * 8/2009 Ernewein ..... B32B 17/10036 52/204.5
7,913,464 B2 * 3/2011 Eckelt ..... B32B 17/10 52/204.54
8,245,465 B2 * 8/2012 Bai ..... E06B 3/5427 52/235
2001/0000274 A1 * 4/2001 Elmer ..... E06B 3/5436 52/235
2001/0023562 A1 * 9/2001 Blobaum ..... B32B 17/10293 52/235
2008/0005983 A1 * 1/2008 Lin ..... E06B 3/5436 52/235
2008/0010921 A1 * 1/2008 Lin ..... E06B 3/5436 52/235
2009/0249736 A1 * 10/2009 Bai ..... E06B 3/5427 52/706
2011/0023391 A1 * 2/2011 Clair ..... E06B 3/5436 52/204.593
2013/0284878 A1 10/2013 Wellershoff
2016/0017596 A1 * 1/2016 Ballesteros ..... E04B 5/46 52/582.1

FOREIGN PATENT DOCUMENTS

| | | | |
|---|---|---|---|
| CN | 103883049 | A | 6/2014 |
| CN | 204385994 | U | 6/2015 |
| DE | 20022393 | U1 | 3/2002 |
| EP | 0931943 | A2 | 7/1999 |
| EP | 0965721 | A1 | 12/1999 |

OTHER PUBLICATIONS

Chinese Office Action for Chinese Application No. 201710021430.5, dated Sep. 17, 2018 (9 pages).

* cited by examiner

GLASS CURTAIN WALL FASTENER

CROSS REFERENCE TO RELATED APPLICATIONS

The present application claims priority under 35 U.S.C. § 119 to Chinese patent Application No. 201710021430.5, entitled "GLASS CURTAIN WALL FASTENER" filed Jan. 11, 2017, the entire content of which is incorporated herein in its entirety.

FIELD OF THE INVENTION

The present disclosure relates to the glass curtain wall technologies, and more particularly relates to a class curtain wall fastener.

BACKGROUND OF THE INVENTION

The class curtain wall is a delicate and novel outer wall for buildings, and it is widely used in modernism high buildings. Conventionally, while building a glass curtain wall, a tail structure of a holding device such as a fastener is connected to an external structure, a glass panels is then assembled into the fastener so as to splice with other panels, finally, a bolt or a screw of the fastener is tightened to fasten the glass panel.

In general, to fasten the glass panel conveniently, the bolt or the screw of the fastener is directly exposed, which will affect the overall beauty of the glass curtain wall. Moreover, the exposed screw or bolt can be randomly disassembled, thus the safety of the curtain wall is affected.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter.

A glass curtain wall fastener includes: a first clamping plate; a second clamping plate provided opposite to the first clamping plate, the first clamping plate and the second clamping plate are configured to hold a glass panel therebetween; a first connecting part provided on a side of the first clamping plate adjacent to the second clamping plate; a second connecting part provided on a side of the second clamping plate adjacent to the first clamping plate; and a connecting element, the first connecting part being connected to the second connecting part via the connecting element. A gap is defined between two adjacent glass panels, the first connecting part, the second connecting part, and the connecting element are received in the gap. At the direction from the first clamping plate to the second clamping plate, the sum of extend length of the first connecting part and the extend length of the second connecting part is less than the thickness of the glass panel, and the extend length of the connecting element is less than the thickness of the glass panel, the rest space of the gap is filled with the structural adhesive.

These and other features of the present invention will become readily apparent upon further review of the following specification and drawings.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE EMBODIMENTS

Figure 1:
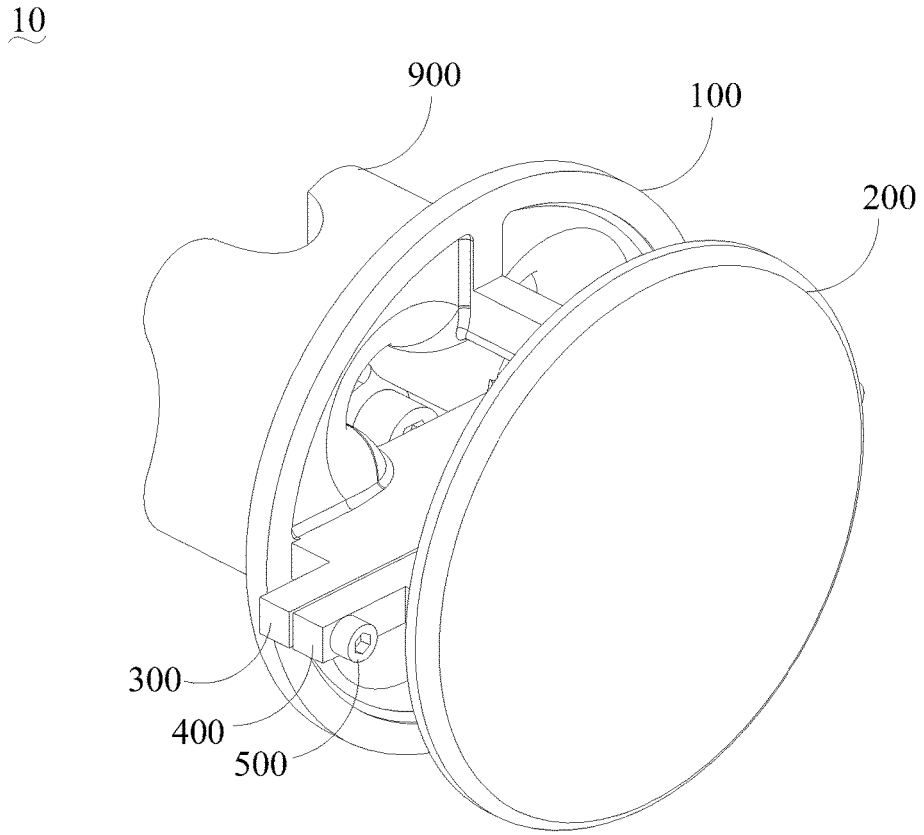
FIG. 1 is a perspective view of a glass curtain wall fastener according to one embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
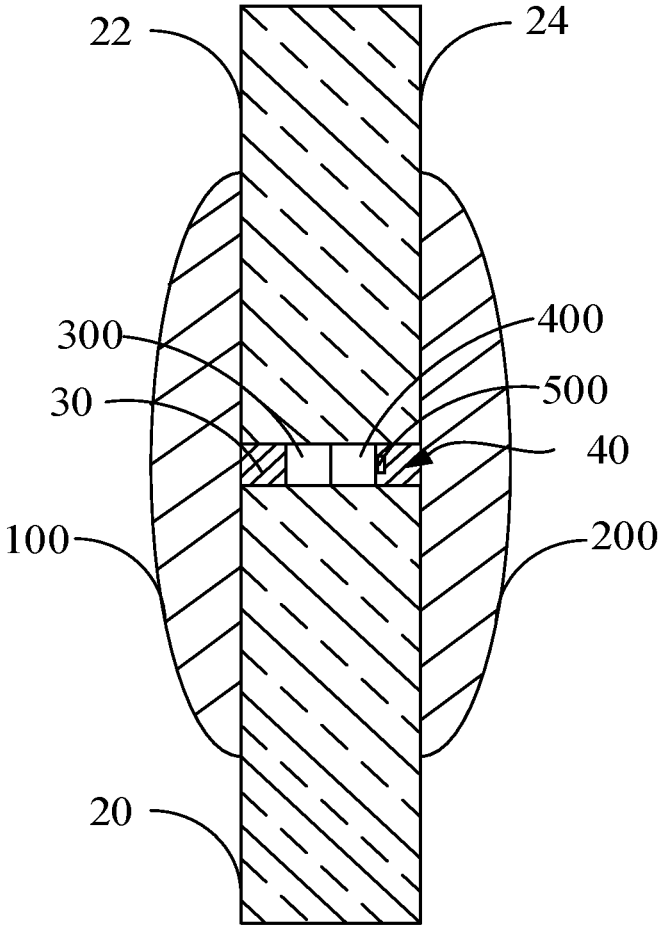
FIG. 2 shows the engagement of the structural adhesive and the glass curtain wall fastener shown in FIG. 1.
Figure 3:
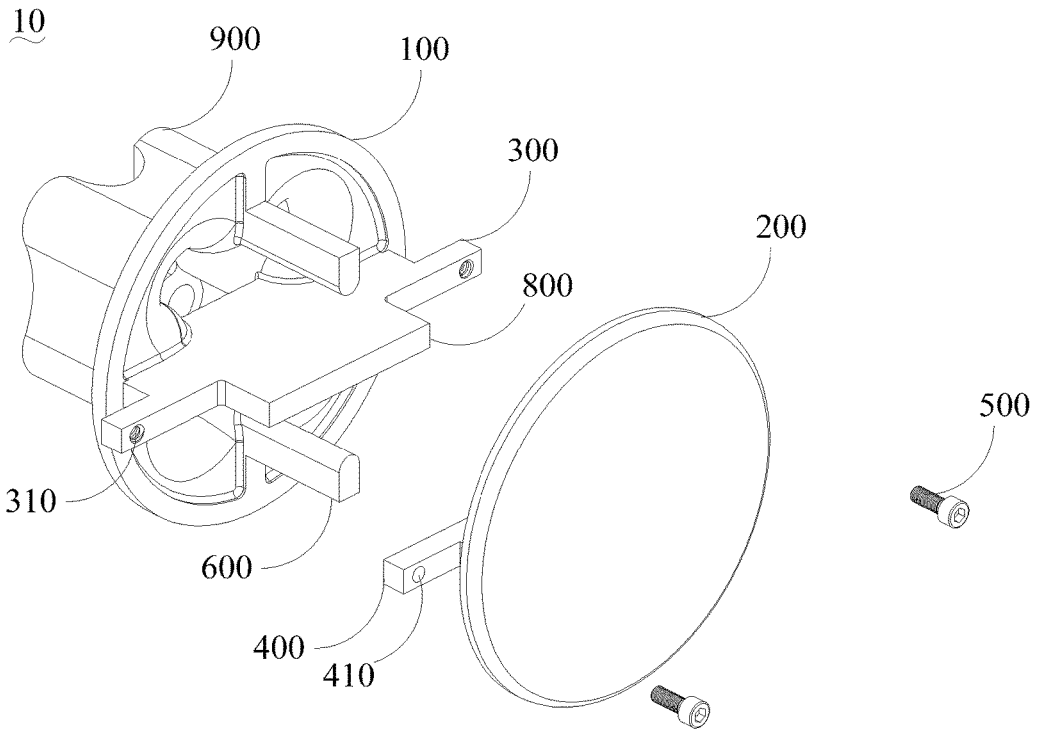
FIG. 3 is an exploded perspective view of the glass curtain wall fastener shown in FIG. 1.

Referring to FIG. 1, FIG. 2 and FIG. 3, a glass curtain wall fastener 10 according to an embodiment is configured to connect a glass panel 20 to an outer structure used for connecting and supporting, such as a steel frame. The glass curtain wall fastener 10 is further configured to achieve splicing between the glass panels 20 with the aid of structural adhesive 30.

Specifically, the glass curtain wall fastener 10 includes a first clamping plate 100, a second clamping plate 200, a first connecting part 300, a second connecting part 400 and a connecting element 500. The first clamping plate 100 and the second clamping plate 200 are oppositely provided to hold the glass panel 20 therebetween, and a side of the first clamping plate 100 away from the second clamping plate 200 is configured to be connected to the outer structure.

The first connecting part 300 is provided on a side of the first clamping plate 100 adjacent to the second clamping plate 200, the second connecting part 400 is provided on a side of the second clamping plate 200 adjacent to the first clamping plate 100. The first connecting part 300 is connected to the second connecting part 400 via the connecting element 500, in other words, the connecting element 500 performs the connection between the first clamping plate 100 and second clamping plate 200.

A gap 40 is defined between two adjacent glass panels 20, the first connecting part 300, the second connecting part 400, and the connecting element 500 are received in the gap 40. In the direction from the first clamping plate 100 to the second clamping plate 200, the sum of extending length of the first connecting part 300 and the extending length of the second connecting part 400 is less than the thickness of the glass panel 20, and the extend length of the connecting element 500 is less than the thickness of the glass panel 20. The remaining space of the gap 40 is filled with the structural adhesive 30. The structural adhesive 30 is a high-strength, anti-stripping, impact and corrosion-resistant adhesive, which not only secures the connection between the glass panels 20 and enhance the safety of the glass curtail wall, but also performs the sealing between the respective glass panels 20.

Furthermore, in the illustrated embodiment, the glass panel 20 has a first side 22 and a second side 24 which are oppositely provided, the first clamping plate 100 is configured to abut against the first side 22, and the second clamping plate 200 is configured to abut against the second side 24. A distance between a side of the first connecting part 300 adjacent to the first clamping plate 100 and the first side 22 equals a distance between the side of the second connecting part 400 adjacent to the second clamping plate 200 and the second side 24, which means that the first connecting part 300 and the second connecting part 400 are located in the center of the gap 40 between the two adjacent glass panels 20.

When splicing the glass panels 20 via the glass curtain wall fastener 10 according to the illustrated embodiment, the connecting element 500 connecting the first connecting part 300 and the second connecting part 400 is received in the gap 40. When the glass panels 20 are assembled, the remaining space of the gap 40 between two adjacent glass panels 20 is filled with the structural adhesive 30 so that the connecting element 500 is shielded. Thus the glass curtain wall not only has a better appearance, the connecting element 500 cannot be dissembled randomly, so that the safety of the glass curtain wall is enhanced.

Referring to FIG. 3, an end of the first connecting part 300 defines a first connecting hole 310, an end of the second connecting part 400 defines a second connecting hole 410. Both axes of the first connecting hole 310 and the second connecting hole 410 are parallel to an axis of the first clamping plate 100. The connecting element 500 extends through the first connecting hole 310 and the second connecting hole 410. In the illustrated embodiment, the connecting element 500 is a bolt or a screw, the first connecting hole 310 is a threaded hole, and the second connecting hole 410 is a through hole. In alternative embodiments, the first connecting hole 310 can be a through hole, the second connecting hole 410 can be a threaded hole.

Moreover, to facilitate connecting the first clamping plate 100 and the second clamping plate 200, a projection of the first connecting hole 310 on a plane of the first clamping plate 100 is located outside of the first clamping plate 100, and a projection of the second connecting hole 410 on a plane of the second clamping plate 200 is located outside of the second clamping plate 200. Since the first connecting part 300 extends out of the first clamping plate 100, and the second connecting part 400 extends out of the second clamping plate 200, a space for the operator to fasten the connecting element 500 is provided.

In an alternative embodiment, the projection of the first connecting part 300 on a plane of the first clamping plate 100 is located inside of the first clamping plate 100, and the projection of the second connecting part 400 on a plane of the second clamping plate 200 is located inside of the second clamping plate 200, in this case, the first connecting hole 310 is a skew hole formed on the first connecting part 300, also the second connecting hole 410 is a skew hole formed on the second connecting part 400, an axis of the first connecting hole 310 coincides with an axis of the second connecting hole 410. Taking the axis of the first connecting hole 310 as an example, at the direction from the edge of the first clamping plate 100 to the center of first clamping plate 100, a distance between the axis of the first connecting hole 310 and the side of the second connecting part 400 adjacent to the first clamping plate 100 gradually increases.

In the illustrated embodiment, two first connecting parts 300 are provided, and the two first connecting parts 300 are symmetrical about the axis of the first clamping plate 100. Two the second connecting parts 400 are provided, each second connecting part 400 corresponds to one of the first connecting parts 300, respectively.

The glass wall curtain fastener 10 further includes two partition bars 600. The partition bar 600 is located between the two first connecting parts 300 and is perpendicular to the first connecting parts 300. One end of the partition bar 600 is connected to the first clamping plate 100, and the other end of the partition bar 600 abuts against the second clamping plate 200. The two partition bars 600 and the first connecting part 300 are configured to abut against the two adjacent sides of the glass panel 20, respectively. The two partition bars 600 are symmetrical about the axis of the first clamping plate 100. Therefore, four glass panels 20 can be spliced via the glass curtain wall fastener 10 according to the illustrated embodiment. In alternative embodiments, only one partition bar 600 is provided, in this case the glass curtain wall fastener 10 can splice two glass panels 20, and suits for the assemble of the glasses at the corner or the edge of the glass curtain wall.

Certainly, in further embodiments, four first connecting parts 300 can be provided, the four first connecting parts 300 are evenly distributed around the axis of the first clamping plate 100, and two adjacent first connecting parts 300 are configured to abut against the two adjacent sides of the glass panel 20, respectively. In this case, the partition bar 600 can be omitted.

Figure 4:
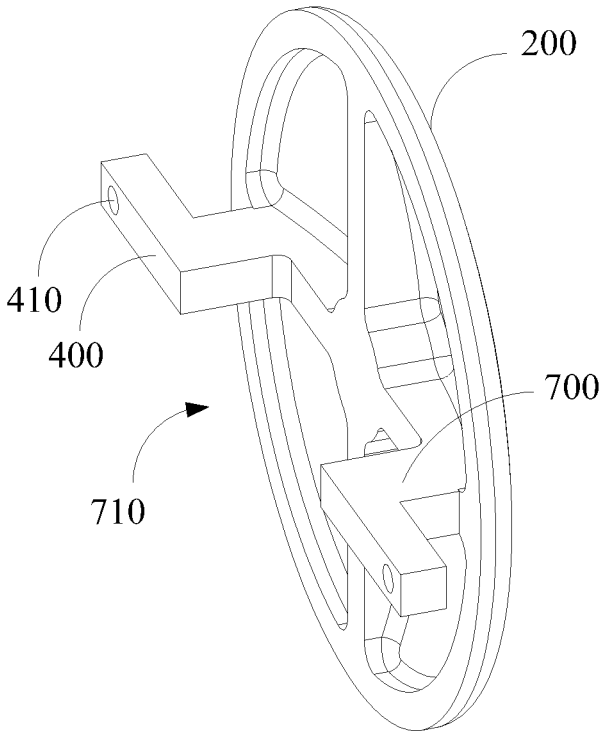
FIG. 4 is a perspective view of a second clamping plate shown in FIG. 1.

Referring to FIG. 3 and FIG. 4, in the illustrated embodiment, the glass curtain wall fastener 10 further includes two connecting bars 700 extending along a direction from the first clamping plate 100 to the second clamping plate 200, and one end of the connecting bar 700 is connected to the second connecting part 400, the other end of the connecting bar 700 is connected to the second clamping plate 200. Each connecting bar 700 corresponds to one of the second connecting part 400, the two connecting bars 700 and the second clamping plate 200 cooperatively form a recess 710.

The glass curtain wall 10 further includes a boss 800, the boss 800 is configured to connect the two first connecting parts 300, and the boss 800 is complementarily received in the recess 710. The engagement of the boss 800 and the recess 710 can further improve the sealing of the glass curtain wall.

Referring to FIG. 1, the glass curtain wall fastener 10 further includes a connecting base 900, one end of the connecting base 900 is connected to the side of the first clamping plate 100 away from the second clamping plate 200, the other end of the connecting base 900 is configured to connect to an outer structure, so as to strengthen the stability of the glass curtain wall.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

The above-mentioned embodiments are merely specific implementations of the present disclosure, but are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A glass curtain wall fastener, comprising:

a first clamping plate;

a second clamping plate provided opposite to the first clamping plate, the first clamping plate and the second clamping plate are configured to hold a glass panel therebetween;

a first connecting part provided on a side of the first clamping plate adjacent to the second clamping plate;

a second connecting part provided on a side of the second clamping plate adjacent to the first clamping plate; and a connecting element, the first connecting part being connected to the second connecting part via the connecting element, wherein the connecting element physically contacts the first connecting part and the second connecting part to connect the first connecting part to the second connecting part;

wherein a gap is defined between two adjacent glass panels when the glass curtain wall fastener is connected to the glass panels, the first connecting part, the second connecting part, and the connecting element are received in the gap; in a direction from the first clamping plate to the second clamping plate, a sum of an extend length of the first connecting part and an extend length of the second connecting part is less than a thickness of the glass panels, and a extend length of the connecting element is less than the thickness of the glass panels, the remaining space of the gap is filled with structural adhesive.

2. The glass curtain wall fastener of claim 1, wherein each glass panel comprises opposed first and second sides, the first clamping plate is configured to abut against the first side, and the second clamping plate is configured to abut against the second side; a distance between a side of the first connecting part adjacent to the first clamping plate and the first side equals a distance between a side of the second connecting part adjacent to the second clamping plate and the second side.

3. The glass curtain wall fastener of claim 1, wherein an end of the first connecting part defines a first connecting hole, an end of the second connecting part defines a second connecting hole, and the connecting element extends through the first connecting hole and the second connecting hole.

4. The glass curtain wall fastener of claim 3, wherein a projection of the first connecting hole on a plane of the first clamping plate is located outside of the first clamping plate, and a projection of the second connecting hole on a plane of the second clamping plate is located outside of the second clamping plate.

5. The glass curtain wall fastener of claim 3, wherein a projection of the first connecting part on a plane of the first clamping plate is located inside of the first clamping plate, and a projection of the second connecting part on a plane of the second clamping plate is located inside of the second clamping plate; the first connecting hole and the second connecting hole are skewed holes, and an axis of the first connecting hole coincides with an axis of the second connecting hole.

6. The glass curtain wall fastener of claim 3, wherein one of the first connecting hole and the second connecting hole is a threaded hole, and the other is a through hole.

7. The glass curtain wall fastener of claim 1, wherein two first connecting parts are provided, and the two first connecting parts are symmetrical about an axis of the first clamping plate, wherein two second connecting parts are provided, each second connecting part corresponds to one of the first connecting parts, respectively;

the glass curtain wall fastener further comprises a partition bar, one end of the partition bar is connected to the first clamping plate, and the other end of the partition bar abuts against the second clamping plate, the partition bar is located between the two first connecting parts and is perpendicular to the first connecting parts, the partition bar and the first connecting part are configured to abut against the two adjacent sides of one of the glass panels when the glass curtain wall fastener is connected to the one of the glass panels, respectively.

8. The glass curtain wall fastener of claim 6, wherein two partition bars are provided, and the two partition bars are symmetrical about the axis of the first clamping plate.

9. The glass curtain wall fastener of claim 6, further comprising two connecting bars extending along a direction from the first clamping plate to the second clamping plate, wherein one end of the connecting bar is connected to the second connecting part, the other end of the connecting bar is connected to the second clamping plate, and each connecting bar corresponds to one of the second connecting parts, the two connecting bars and the second clamping plate cooperatively form a recess; and the glass curtain wall fastener further comprises a boss configured to connect the two first connecting parts, and the boss is complementarily received in the recess.

10. The glass curtain wall fastener of claim 1, wherein four first connecting parts are provided, the four first connecting parts are evenly distributed around an axis of the first clamping plate, and two adjacent first connecting parts are configured to abut against the two adjacent sides of one of the glass panels when the glass curtain wall fastener is connected to the one of the glass panels, respectively.

11. The glass curtain wall fastener of claim 1, further comprising a connecting base, wherein an end of the connecting base is connected to a side of the first clamping plate away from the second clamping plate.

* * * * *